US006685416B2

(12) United States Patent
Itoh et al.

(10) Patent No.: US 6,685,416 B2
(45) Date of Patent: Feb. 3, 2004

(54) BOOKBINDING DEVICE AND METHOD

(75) Inventors: Katsuyasa Itoh, Kyoto (JP); Masahiko Sakai, Kyoto (JP); Motohiro Susa, Aichi (JP); Katsumi Maeda, Aichi (JP); Toshiaki Tsukahara, Osaka (JP); Maki Takimura, Kyoto (JP); Hajime Nishimura, Saitama (JP); Junji Chatani, Saitama (JP)

(73) Assignees: Dynic Corporation, Kyoto (JP); Kyokko Seiko Co., Ltd., Kyoto (JP)

( * ) Notice: Subject to any disclaimer, the term of this patent is extended or adjusted under 35 U.S.C. 154(b) by 78 days.

(21) Appl. No.: 10/117,048

(22) Filed: Apr. 8, 2002

(65) Prior Publication Data

US 2003/0012622 A1 Jan. 16, 2003

(30) Foreign Application Priority Data

Jul. 11, 2001 (JP) ..... P2001-211000
Jul. 11, 2001 (JP) ..... P2001-211001
Jul. 11, 2001 (JP) ..... P2001-211003

(51) Int. Cl.[7] ..... B42C 9/00

(52) U.S. Cl. ..... 412/37; 270/52.17; 270/58.04; 412/19

(58) Field of Search ..... 412/37, 33, 1, 412/4, 5, 6, 8, 9, 18, 19; 270/52.17, 58.07

(56) References Cited

U.S. PATENT DOCUMENTS 4,484,850 A 11/1984 Shimizu
4,904,138 A 2/1990 Champeaux et al.
5,152,654 A * 10/1992 Luhman et al. ..... 412/37
6,000,894 A * 12/1999 Suzuki et al. ..... 412/11
6,193,458 B1 * 2/2001 Marsh ..... 412/1
6,460,843 B1 * 10/2002 Dim et al. ..... 270/58.07

FOREIGN PATENT DOCUMENTS

| | | |
|---|---|---|
| JP | 01-304994 | 12/1989 |
| JP | 06-048065 | 2/1994 |
| JP | 07-276849 | 10/1995 |
| JP | 09-220874 | 8/1997 |
| JP | 09-220875 | 8/1997 |
| JP | 09-220878 | 8/1997 |
| JP | 09-234974 | 9/1997 |
| JP | 10-245150 | 9/1998 |
| JP | 11-034536 | 2/1999 |
| JP | 11-078287 | 3/1999 |
| JP | 11-105455 | 4/1999 |
| JP | 2000-168264 | 6/2000 |
| JP | 2000-168265 | 6/2000 |
| JP | 2001-071660 | 3/2001 |
| JP | 2001-071661 | 3/2001 |

* cited by examiner

*Primary Examiner*—Derris H. Banks
*Assistant Examiner*—Jamila O Williams
(74) *Attorney, Agent, or Firm*—Rothwell, Figg, Ernst & Manbeck

(57) ABSTRACT

A bookbinding device is disclosed to adhesively bind a back surface of a stack of pages to a center portion of a cover page, which includes a page supply unit (1), a thickness sensor (2), an adhesive applicator (3), a page conveyor unit (4), a cover supply unit (5), a press unit (8) and a cover folding unit (9). The cover supply unit includes a trimmer (6) for trimming a side edge portion of the cover sheet depending upon thickness of the page stack detected by the thickness sensor, and a positioning unit (7) for positioning the cover sheet such that a center line of the cover sheet which has been trimmed by the trimmer is aligned with a center of thickness of the page stack, at which position the page stack is adhesively bound to the cover sheet.

13 Claims, 11 Drawing Sheets

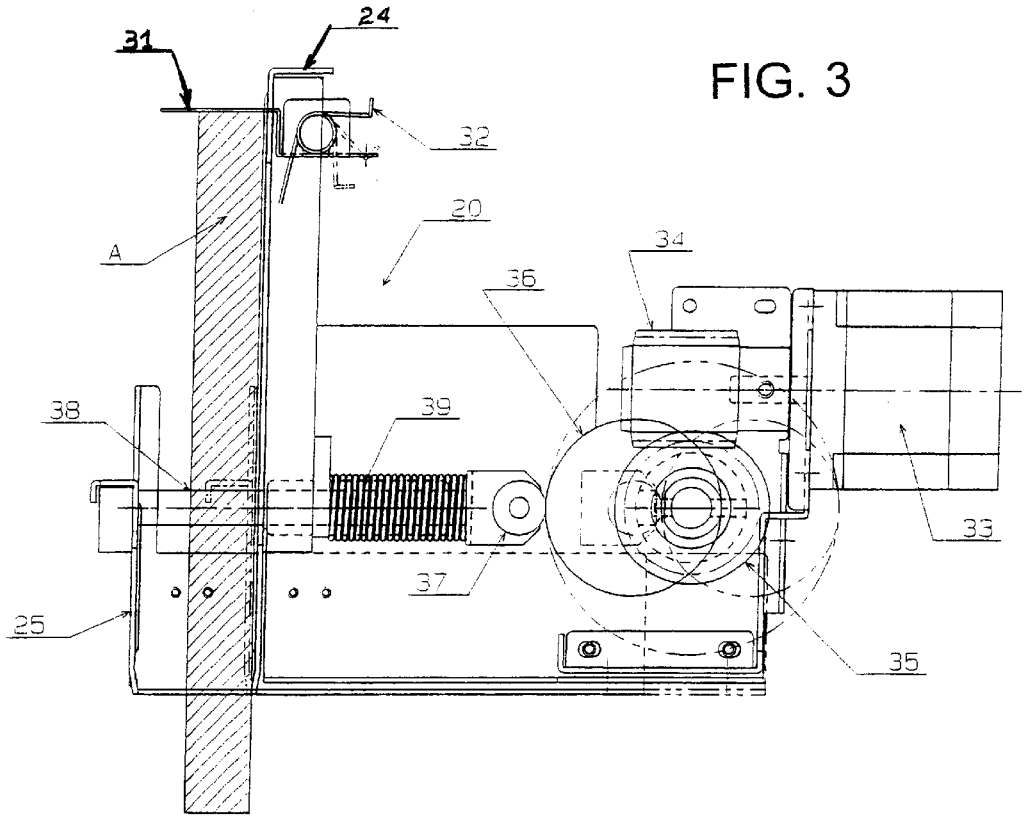
FIG. 3
FIG. 6
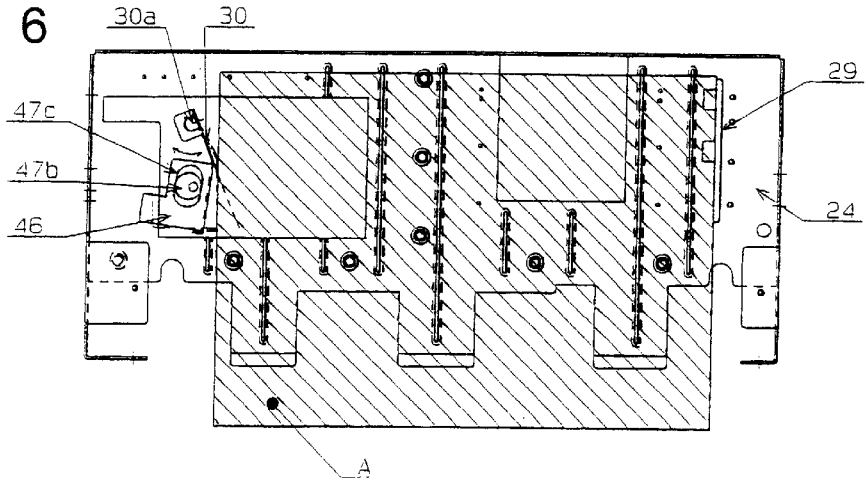

BOOKBINDING DEVICE AND METHOD

BACKGROUND OF THE INVENTION

1. Field of the Invention

The present invention relates to a bookbinding device and method in which a page stack is bound together with a cover sheet by using hot melt adhesive which is applied to a back surface of the page stack.

2. Prior Art

Many attempts have been made to bind a page stack with a cover sheet by hot melt adhesive applied to a back surface of the page stack into a unitary assembled booklet. In one prior art bookbinding technic, a page stack and a cover sheet are separately transported to a gluing station where a back surface of the page stack, to which hot melt adhesive in a molten condition has been applied during conveyance thereof, is pressed against a center portion of the cover sheet for adhesive binding between the cover sheet and the page stack, followed by folding the cover sheet at lines spaced corresponding to thickness of the page stack for bookbinding into a unitary assembled booklet. In a modified prior art, at a glueing station, a back surface of a page stack is pressed against a center portion of a cover sheet to which hot melt adhesive in a molten state has been applied for adhesive binding of the cover sheet and the page stack. In still another prior art, a center portion of a cover sheet to which a strip of hot melt adhesive is attached is subjected to a heater so that the hot melt adhesive strip is heated to above its melting point, and then a back surface of a page stack is pressed against the center portion for adhesive binding between the cover sheet and the page stack, followed by folding the cover sheet at lines spaced corresponding to thickness of the page stack for bookbinding into a unitary assembled booklet.

A page stack to be bound may have a variety of thickness. According to the above-recited prior arts, a cover width of a resulting booklet will vary depending upon thickness of the page stack, which requires that a cover sheet of a larger size is used in bookbinding and additional steps of trimming the cover sheet depending upon a size of the booklet and dumping the scraps produced after trimming. This will decrease work efficiency and exhaust resources.

Another attempt has been made to provide a set of spaced crease lines on an inside of a central portion of a cover sheet, among which two are selected as folding lines depending upon thickness of a page stack. However, in most case, the selected two lines could not definitely be equal to but is actually somewhat larger than the true thickness of the page stack. Whichever lines are selected, definite alignment between the center of thickness of the page stack and the center of the cover sheet could not be achieved. Further, this prior art also has a drawback which have been described in connection with the afore-mentioned prior arts so that a cover width of a resulting booklet varies depending upon thickness of the page stack.

In a device disclosed in Japanese patent publication No. 6-43152, crease lines spaced in conformity to thickness of a page stack is formed on a center portion of a cover sheet, and a continuous sheet of hot melt adhesive is cut into a strip of width corresponding to the thickness of the page stack, which is placed between the spaced crease lines on the center portion of the cover sheet or alternatively on a hot plate. The hot melt strip is then heated to above its melting point so that a back surface of the page stack is bonded to the center portion of the cover sheet.

With this device, the crease lines are spaced conforming to the thickness of the page stack, so that definite alignment or centering between the cover sheet and the page stack in a resulting booklet can be achieved. This prior art, however, provide no solution to a problem that a cover width of a resulting booklet varies depending upon thickness of the page stack and, therefore, requires post-bookbinding step of trimming at least one side edge of the cover sheet and a subsequent dumping step.

The above-recited prior art device is provided with a lever handle which may be automatically operated to cut the hot melt adhesive sheet into a strip having a predetermined width corresponding to the thickness of the page stack, Yet, a subsequent step of placing the cut sheet or strip onto a predetermined platform is not automated, which requires manual operation to pick up the hot melt adhesive strip and move it onto the platform. This means that the device can not provide fully-automated bookbinding operation. Moreover, the hot melt adhesive strip tends to be offset from a predetermined position on the platform. Even if it is once placed in position, it may be displaced or moved during operation of the device. Accordingly, it is desirable that a pressure-sensitive adhesive layer or the like is formed on the underside of the hot melt adhesive sheet to prevent displacement of the hot melt adhesive strip on the platform before melt by heating, which increases production cost.

A title indicating the contents of the booklet or any decorative image is often printed beforehand on a cover sheet, which is supplied to a bookbinding device. In accordance with the prior art bookbinding technic, however, as described before, a center line in width of a cover of a resulting booklet varies depending upon thickness of a page stack so that the printed title or image may appear on the cover in an offset position. Such offset positioning becomes remarkable and looks unattractive when a cover has a full-page print.

To produce booklets with beautiful appearance, it is necessary to jog back edges of pages to be bound during conveyance of the page stack. While such jogging device is disclosed in some prior arts including Japanese patent publication Nos. 60-191956, 5-77585, 5-77579, 8-12174, 10-203714 and Japanese utility model publication No. 63-90658, none of them could not provide uniform jogging effect where thickness of the page stack is varied.

SUMMARY OF THE INVENTION

Accordingly, it is a primary object of the present invention to overcome the drawbacks and disadvantages of the prior art bookbinding technic and provide a novel bookbinding device and method which involves cutting a cover sheet depending upon thickness of a page stack to be bound so that a cover of a resulting booklet should always agrees with a width size of the page stack, which may omit a post-bookbinding cover-cutting.

Another object of the present invention is to provide a bookbinding device with a jogger capable of providing uniform and sufficient jogging effect even when the page stack has varying thickness.

To achieve these and other objects, according to an aspect of the present invention, there is provided a bookbinding device comprising a page supply unit for supplying a stack of pages to be bound to a predetermined first station, the page stack being kept in a clamped condition from opposite sides thereof; a thickness sensor for detecting thickness of the clamped page stack during supply thereof by the page supply unit; an adhesive applicator for applying molten adhesive to a back surface of the page stack at the first station; a page conveyor unit for conveying the page stack with the glued back surface from the first station to a second station remote from the first station; a cover supply unit for supplying a cover sheet to beneath the glued back surface of the page stack at the second station; a press unit for contacting under pressure the glued back surface of the page stack with a center portion of the cover sheet for adhesive binding therebetween; and a cover folding unit for folding the cover sheet substantially along opposite side edges of the page stack to form a unitary assembled booklet; the cover supply unit including a trimmer for trimming a side edge portion of the cover sheet depending upon thickness of the page stack detected by the thickness sensor, and a positioning unit for positioning the cover sheet such that a center line of the cover sheet which has been trimmed by the trimmer is aligned with a center of thickness of the page stack at the second position.

The bookbinding device may further comprise a scrap discharging unit for discharging scraps produced after the trimmer trims the side edge portion of the cover sheet, through a scrap chute that is independent from a cover sheet travel path defined by the cover supply unit. Preferably, a changeover switch is arranged just beneath the trimmer, which is regulated in synchronism with operation of the trimmer so as to guide the scrap into the scrap chute and guide the trimmed cover sheet to feed along the cover sheet travel path.

The bookbinding device may further be provided with a printer unit arranged along the cover sheet travel path between the trimmer and the second station for printing any desired image on the cover sheet.

The page supply unit preferably comprises a clamper for clamping the page stack from opposite sides thereof; a release mechanism for unclamping the page stack at a jogging station where the page stack is kept substantially upstanding or slanting; a holder unit with a bottom support for supporting a bottom edge of the page stack when the page stack is unclamped by the release mechanism; a first vibration generator for vibrating the holder unit in up-and-down directions to jog the bottom edge of the page stack; a second vibration generator for vibrating the page stack in its width directions to jog opposite side edges of the page stack; and a spring-biased press member for press- and resilient-contact with a top edge of the page stack while being vibrated in up-and-down directions by the first vibration generator.

In this embodiment, the holder unit may comprise a base to which the bottom support is fixed, and a second bottom support slidably connected to the base. The bottom support provides a supporting surface positioned between an uppermost position and a lowermost position of the elevatable second bottom support. The second bottom support is vibrated by the first vibration generator.

In another embodiment, the holder unit comprises a stationary guide member for definitely positioning a first side edge of the page stack and a movable guide member adapted to provide resilient contact with a second side edge, opposite to the first side edge, of the page stack. In this embodiment, the second vibration generator may comprise a swingable arm with a contact surface opposing to the second side edge of the page stack, and an actuator for swinging the arm so that the contact surface intermittently collides against the second side edge of the page stack.

According to another aspect of the present invention, there is provided a bookbinding device comprising a clamper for clamping the page stack from opposite sides thereof; a release mechanism for unclamping the page stack at a jogging station where the page stack is kept substantially upstanding or slanting; a holder unit with a bottom support for supporting a bottom edge of the page stack when the page stack is unclamped by the release mechanism; a first vibration generator for vibrating the holder unit in up-and-down directions to jog the bottom edge of the page stack; a second vibration generator for vibrating the page stack in its width directions to jog opposite side edges of the page stack; and a spring-biased press member for press-contact with a top edge of the page stack while being vibrated in up-and-down directions by the first vibration generator.

The holder unit may comprise a base to which the bottom support is fixed, and a second bottom support slidably connected to the base. The bottom support provides a supporting surface positioned between an uppermost position and a lowermost position of the elevatable second bottom support. The second bottom support is vibrated by the first vibration generator.

In another embodiment, the bookbinding device unit further comprises a stationary guide member for definitely positioning one side edge of the page stack and a movable guide member adapted to provide spring-biased contact with the other side edge of the page stack. In this embodiment, the second vibration generator may comprise a swingable arm with a contact surface opposing to the other side edge of the page stack, and an actuator for swinging the arm so that the contact surface intermittently collides against the other side edge of the page stack.

According to still another aspect of the present invention, there is provided a bookbinding method comprising the steps of supplying a stack of pages to be bound to a first station, the page stack being kept in a clamped condition from opposite sides thereof; detecting thickness of the clamped page stack during supply thereof; applying molten adhesive to a back surface of the page stack at the first station; conveying the page stack with the glued back surface from the first station to a second station remote from the first station; trimming a side edge portion of a cover sheet depending upon thickness of the page stack; supplying the cover sheet with the trimmed side edge portion to beneath the glued back surface of the page stack such that a center line of the cover sheet is aligned with a center of thickness of the page stack at the second position; contacting under pressure the glued back surface of the page stack with the cover sheet for adhesive binding therebetween; and folding the cover sheet substantially along opposite side edges of the page stack to form a unitary assembled booklet.

BRIEF DESCRIPTION OF THE DRAWINGS

Other objects and advantages of the present invention can be understood from the following description when read in conjunction with the accompanying drawings in which:

FIG. 3 is an enlarged sectional view showing a sub-clamper and elements associated thereto of the bookbinding device of FIG. 2;

FIG. 6 is an enlarged plan view showing the sub-clamper and elements associated thereto;

DETAILED DESCRIPTION OF THE PREFERRED EMBODIMENT

Figure 1:
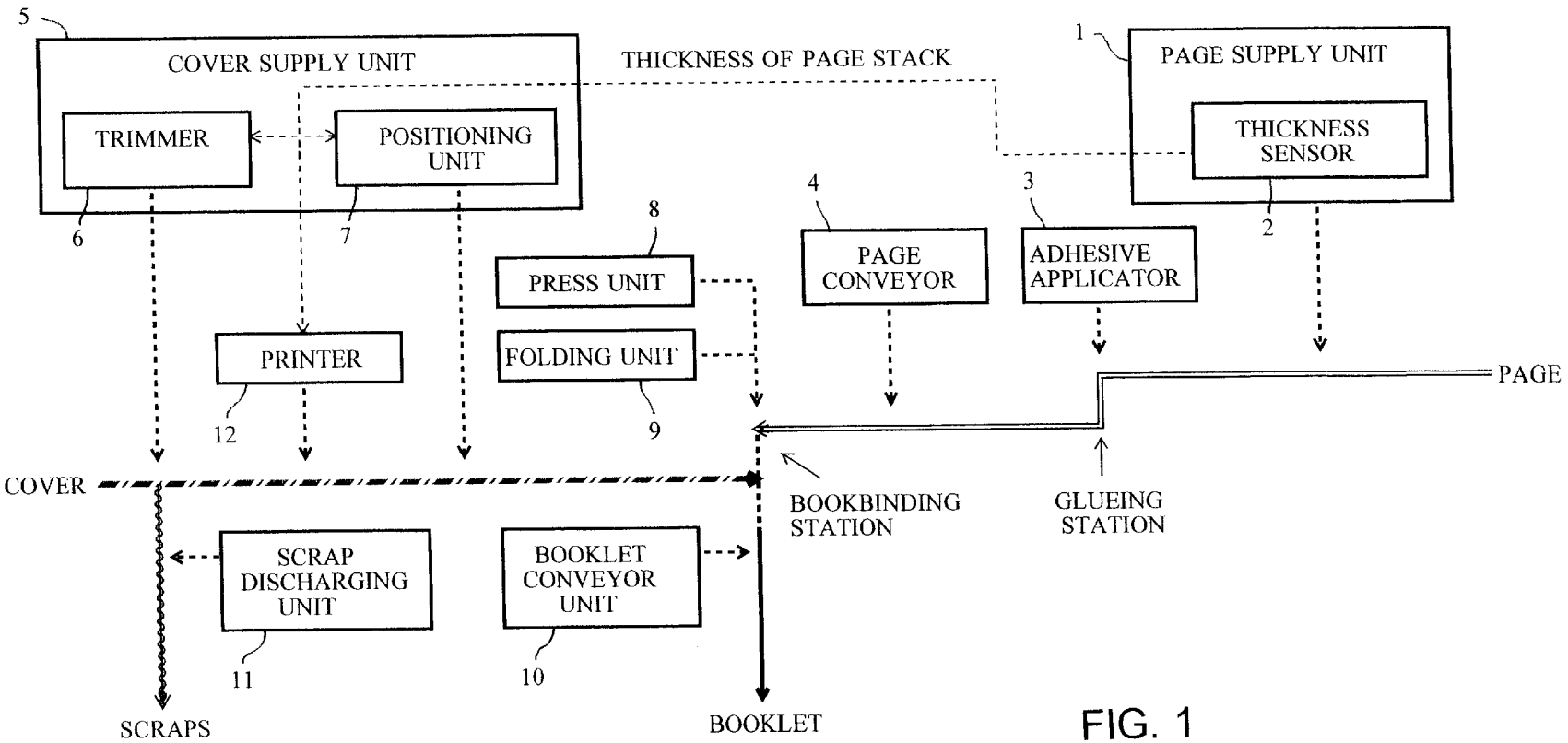
FIG. 1 is a block diagram of a bookbinding according to the present invention.

Referring first to FIG. 1, a bookbinding device of the present invention comprises in general a page supply unit 1 including a thickness sensor 2, an adhesive applicator 3, a page conveyor unit 4, a cover supplying unit 5 including a trimmer 6 and a positioning unit 7, a press unit 8, a cover folding unit 9, a booklet conveyor unit 10 and a scrap discharging unit 11.

Page supply unit 1 supplies a stack of pages to be bound to a first, glueing station. During supply to the glueing station, the page stack is kept in a clamped condition from opposite sides thereof. Sensor 2 detects thickness of the clamped page stack during supply thereof by page supply unit 1. Adhesive applicator 3 applies hot melt adhesive in a molten state to a back surface of the page stack which has been supplied to the glueing station by page supply unit 1. Page conveyor unit 4 conveys the page stack with the glued back surface from the glueing station to a second, bookbinding station.

Cover supply unit 5 supplies a cover sheet to beneath the glued back surface of the page stack at the bookbinding station. At this time, the page stack has been conveyed by page conveyor unit 4 and is positioned standstill at the bookbinding station. Trimmer 6 operates responsive to a result of detection by thickness sensor 2 to trim a side edge portion of the cover sheet depending upon thickness of the page stack. Positioning unit 7 operates also responsive to a result of detection by thickness sensor 2 to determine and control position of the cover sheet at the bookbinding station such that a center line of the trimmed cover sheet is aligned with a center of thickness of the page stack. Scrap discharging unit 11 discharges paper scraps produced after trimming through a scrap chute that is independent from a cover sheet travel path defined by cover supply unit 5.

Press unit 8 is adapted to contact under pressure the glued back surface of the page stack with a center portion of the cover sheet for adhesive binding therebetween. Cover folding unit 9 folds the cover sheet substantially along opposite side edges of the page stack to form a unitary assembled booklet. Such functions of press unit 8 and cover folding unit 9 may be achieved by a single unit or mechanism, as in an illustrated embodiment to be described hereinlater. The resulting booklet is discharged from booklet conveyor unit 10 toward a predetermined safekeeping station or the like.

A printer unit 12 may be of any known type, including ink jet type, by which any desired characters or images may be printed on the cover sheet. As described before, the cover sheet has been trimmed to a predetermined size really corresponding to the thickness of the page stack detected by sensor 2, so that a center of a cover page of a booklet to be produced can be determined with respect to the trimmed cover sheet. Printer unit 12 receives such center position data and operates in response to input of print command data to execute printing, without displacement of pattern printed on the cover page. This is especially useful in a full-page printing. According to the teachings of the present invention, printer unit 12 may be assembled in an automated bookbinding device, which should be compared with the prior art in which a printing step is carried out before a cover sheet is supplied to a bookbinding device.

Although not shown in FIG. 1, there is a control device such as a computer which receives the result of detection by sensor 2 to thereby controls operation of trimmer 6, positioning unit 7 and printer unit 12, respectively.

Figure 2:
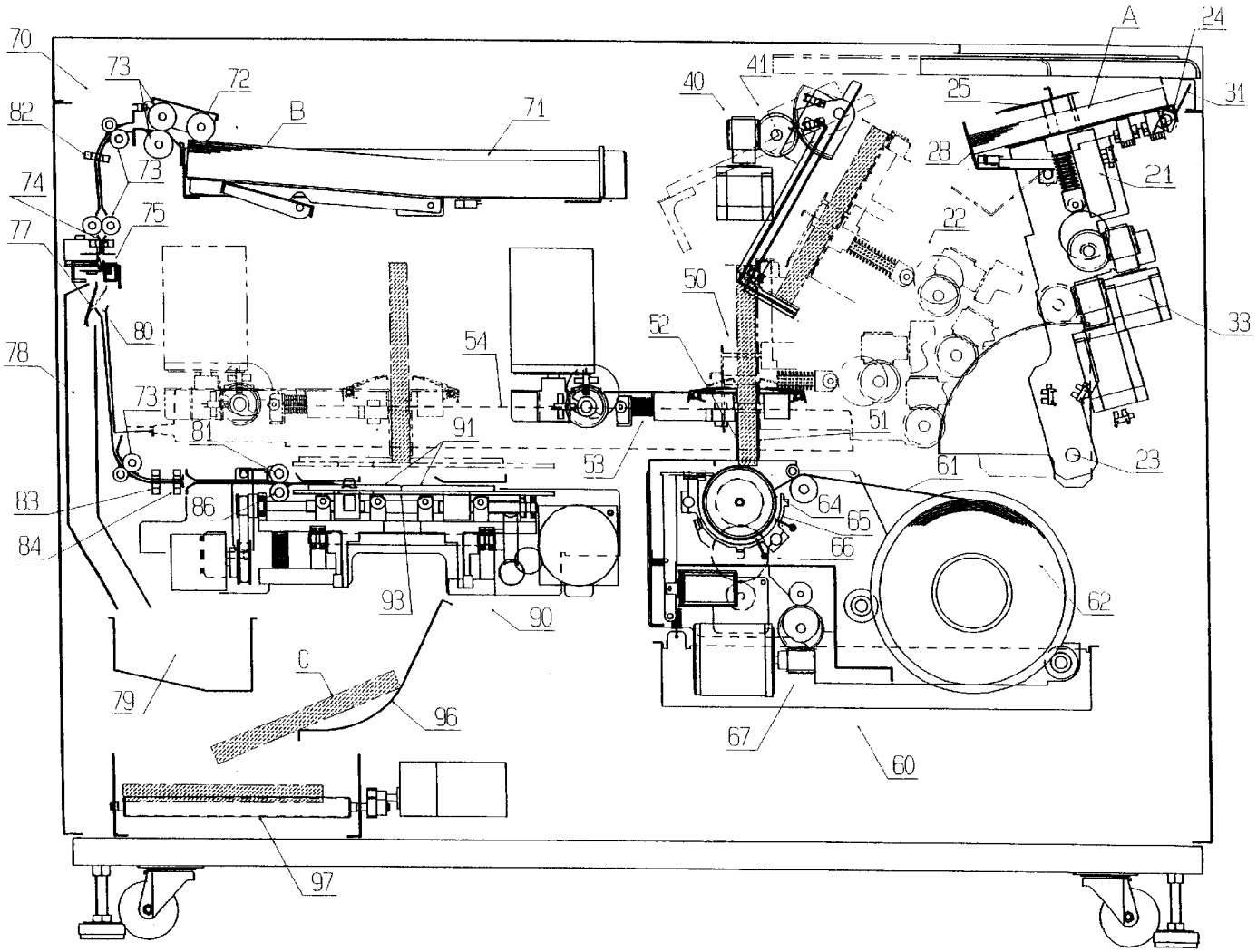
FIG. 2 is a front view diagrammatically showing overall arrangement of a bookbinding device embodying the present invention.

Reference should now be made to FIG. 2 illustrating a bookbinding device embodying the present invention, which includes most elements shown in FIG. 1 but does not include printer unit 12. In the embodiment of FIG. 2, page supply unit 1 (FIG. 1) comprises in main a sub-clamper 20 to which a thickness sensor 21 is attached.

Sub-clamper 20 is swingable about an axis 23 by a rotation drive mechanism 22. sub-clamper 20 is controlled by a controller, not shown, to swing between a stand-by position shown by solid lines where it awaits supply of a page stack, a jog position at an angle of approximately 60 degrees from the stand-by position in a counter-clockwise direction where the unclamped page stack is subjected to jogging operation, and a delivery position at an angle of approximately 30 degrees from the jog position in a counter-clockwise direction where the jogged page stack is delivered to a main clamper 50.

Figure 4:
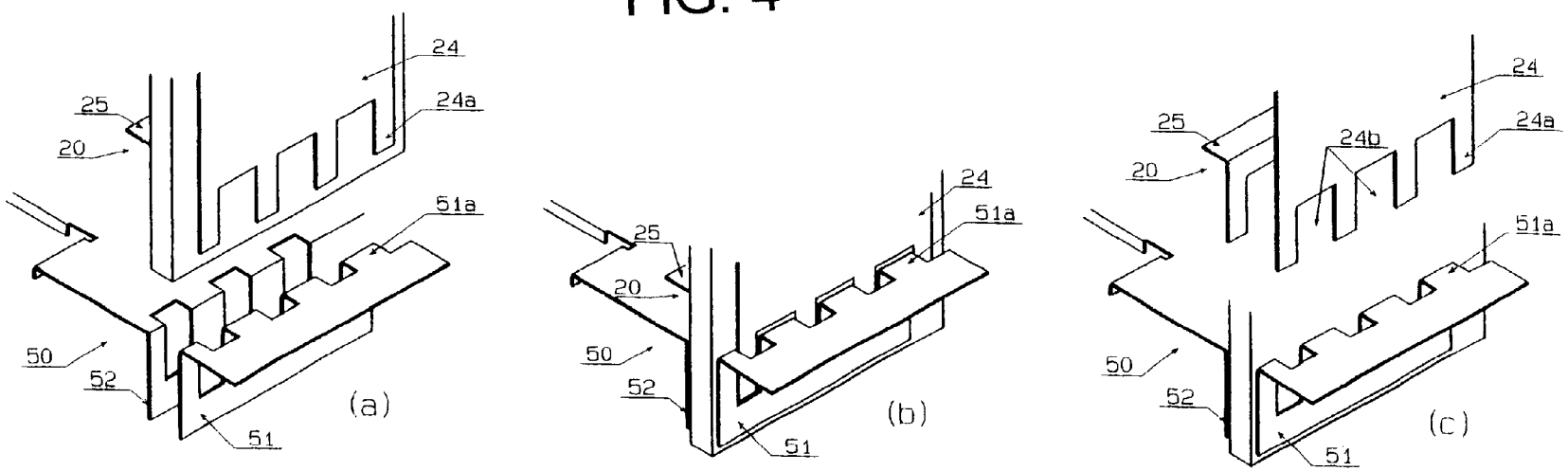
FIG. 4 is a perspective view showing leading end portions of the sub-clamper and a main clamper of this bookbinding device, which also shows a manner of deliver of a page stack from the sub-clamper to the main clamper.

Sub-clamper 20 has a table 24 adapted to receive thereon a stack of pages A to be bound by this bookbinding device, a clamping plate 25 for holding the page stack A down to table 24, and an elevating mechanism, not indexed, for elevation of clamping plate 25 in a direction of thickness of the page stack A held between table 24 and clamping plate 25. An example of the elevating mechanism is shown in FIG. 3, which comprises a motor 33, a warm gear 34, a warm wheel 35, an eccentric cam 36, and a cam follower 37 always in contact with cam 36, a shaft 38 having one end connected to cam follower 37 and the other end connected to clamping plate 25. Rotation of motor 33 is transmitted via warm gear 34 and warm wheel 35 to eccentric cam 36. As eccentric cam 36 rotates, shaft 38 is moved in its axial direction to move clamping plate 25 with respect to table 24. A spring 39 around shaft 38 assures constant contact of cam follower 37 with a periphery of eccentric cam 36 and, in turn, provide a necessary clamping force to the page stack A when it is clamped between table 24 and clamping plate 25. As shown in FIG. 4, table 24 and clamping plate 25 respectively have teethed end portions comprising spaced projections 24*a*, 25*a* and recesses 24*b*, 25*b* defined between adjacent projections.

Figure 5:
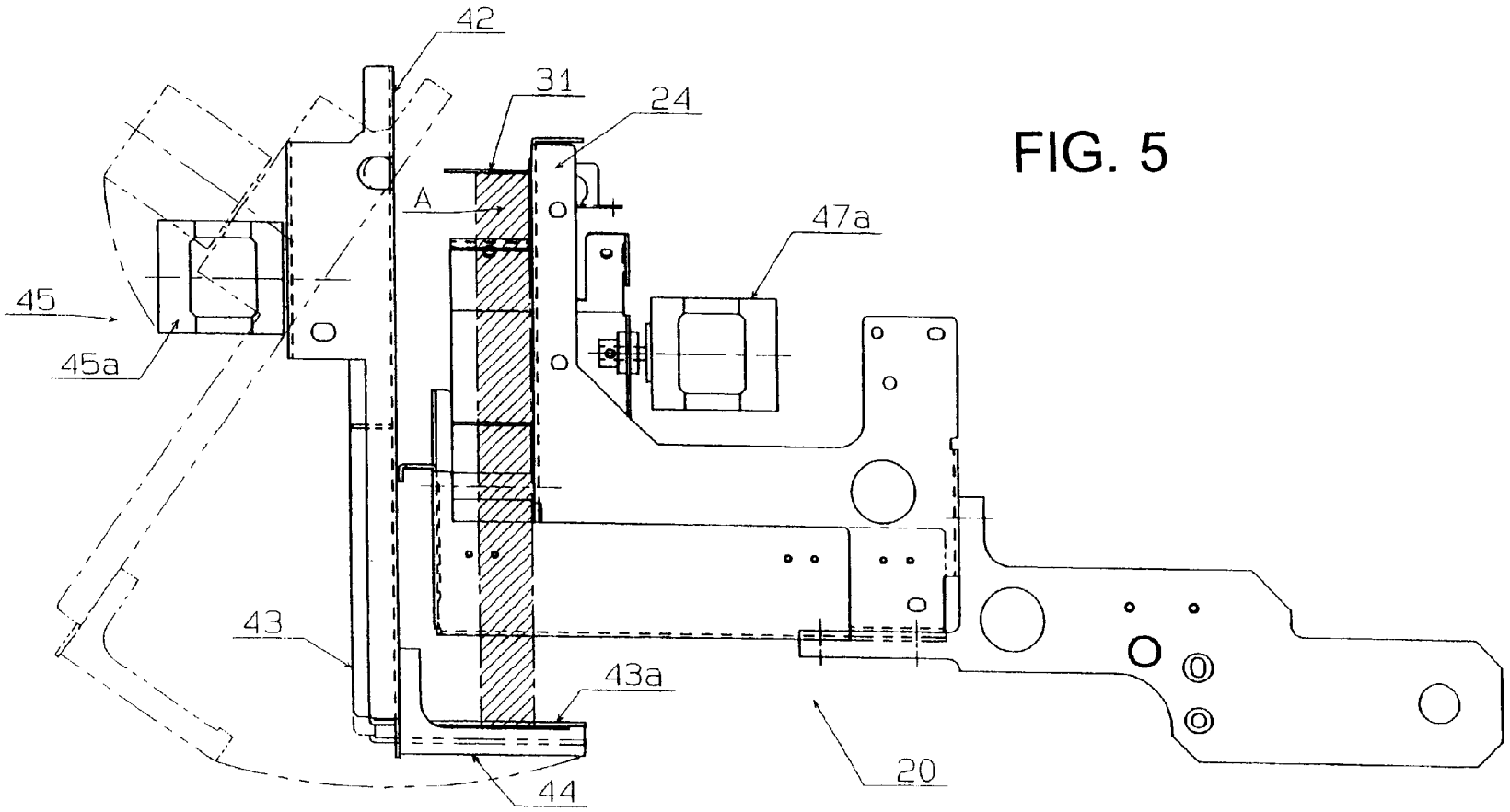
FIG. 5 is a plan view showing arrangement of this bookbinding device relating to the sub-clamper and a jog unit.

A ratable stopper 28 is provided near the front end, shown in FIG. 2 as a left-hand end, of table 24 for engaging the front edge of the page stack A placed on table 24. A stationary guide 29 engages one side edge of the page stack A whereas a movable guide 30 engage the other side edge thereof, as shown in FIG. 6. Stationary guide 29 is fixed to table 24. Movable guide 30 is biased by a spring, not shown, to rotate about an axis 30*a* in a counter-clockwise direction in FIG. 6 so that it always provide spring-biased contact with a left-hand side in FIG. 6 of the page stack A on table 24. Thus, the page stack A on table 24 may be held in definite position by cooperation of these guide members 29, 30, irrespective of thickness variation of the page stack A to be bound. sub-clamper 20 is also provided with a rotatable press arm 31 for engaging the rear edge of the page stack A on table 24, as can be seen in FIG. 3 and FIG. 5. Arm 31 is biased by a coil spring 32 to rotate in a counter-clockwise direction in FIG. 5. Arm 31 is not only an element of page supply unit 1 (FIG. 1) but also an element of a jog unit 40 to be described hereinlater. Though not shown, sub-clamper 20 also includes a size sensor for detecting a size (A4, B5, . . . ) of the page stack A supplied onto table 24.

Referring to FIGS. 5, 6, 10 and 11, jog unit 40 is adapted to apply vibration or jogging movement to the page stack A clamped between table 24 and clamping plate 25 of sub-clamper 20, when sub-clamper 20 with the clamped page stack A has been moved by drive mechanism 22 from the stand-by position to the jog position. Jog unit 40 comprises a base arm 42 swingable by a drive mechanism 41 between a stand-by position shown by dotted lines in FIG. 2 and an operative position shown by solid lines in FIG. 2, an L-shaped jog plate 43 slidably connected to base arm 42, a positioning member 44 fixed to the lower end of base arm 42 and extends perpendicular to the plane of base arm 42, a vibration generator 45 for vibrating jog plate 43 with respect to and in parallel to base arm 42, the aforementioned press arm 31, a swingable piece 46 arranged near the left-hand edge (in FIG. 6) of the page stack A on table 24, and another vibration generator 47 for swinging piece 46 for intermittent collision with the left-hand edge of the page stack A.

Figure 11:
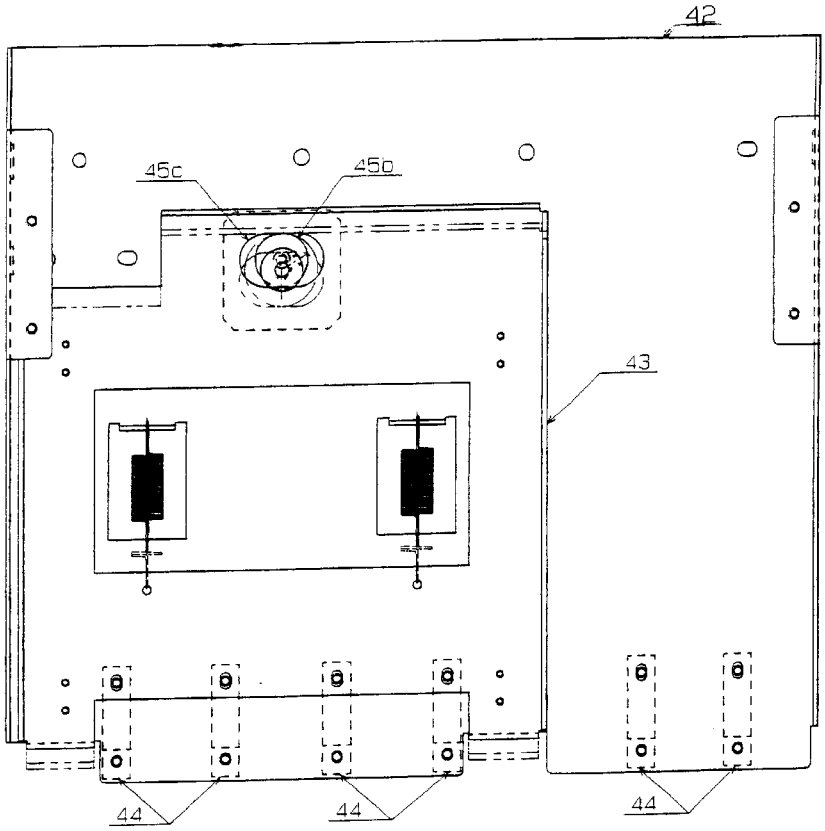
FIG. 11 is a front view of the jog unit.

In this embodiment, positioning member 44 comprises a plurality of spaced L-shaped pieces, as best seen in FIG. 11. Vibration generator 45 comprises a motor 45*a*, an eccentric cam 45*b* driven by motor 45*a* and an engagement hole 45*c* formed in jog plate 43 for engagement with eccentric cam 45*b*. Likewise, vibration generator 47 comprises a motor 47*a*, an eccentric cam 47*b* driven by motor 47*a* and an engagement hole 47*c* formed in jog plate 43 for engagement with eccentric cam 47*b*.

Jog unit 40 provides jogging operation both in up-and-down directions and in width directions, after the page stack A on sub-clamper 20 is unclamped at the jog position. Vertical jogging is achieved by vibration of jog plate 43 that supports the bottom edge of the page stack A while its top edge engages with spring-biased arm 31. Side-by-side jogging is achieved by vibration of singable piece 46 for intermittent collision with one side edge of the page stack A while the other side edge is kept in position by stationary guide 29. Press arm 31 is permitted to rotate in a clockwise direction (in FIG. 5) against the biasing force by spring 32, which allows slight movement of the page stack A during vibration of jog plate 43. Spring-biased guide 30 is constantly in elastic engagement with the left-hand edge of the page stack A, which prevents spring-back of the page stack A when piece 46 is moved away from the page stack A during side-by-side jogging operation.

The upper surface of positioning members 44 is at a level intermediate between the uppermost position and the lowermost position of a support 43*a* of elevatable jog plate 43. Accordingly, during ascent of jog plate 43 from the lowermost position toward the uppermost position, it carries the page stack A. Then, during descent of jog plate 43 from the uppermost position toward the lowermost position, the bottom edge of the page stack A collides with positioning members 44. Such is repeated to provide improved effect of vertical jogging.

Main clamper 50 is an principal element of page conveyor unit 4 (FIG. 1), which comprises a movable clamping plate 51, a stationary clamping plate 52, a drive mechanism 53 for moving plate 51 with respect to plate 52 to open and close main clamper 50, and a shift mechanism 54 for laterally moving main clamper 50. Drive mechanism 53 may be similar to the elevating mechanism in sub-clamper 20, which has been described in reference to FIG. 3.

Shift mechanism 54 is regulated such that main clamper 50 takes three positions, that is, a page receiving position where the page stack A conveyed by sub-clamper 20 to the delivery position is delivered to main clamper 50 in a manner described hereinbelow, a glueing position and a bookbinding position. In FIG. 2, the page receiving position of main clamper 50 is shown by solid lines, whereas its bookbinding position is shown by dotted lines. It is noted that the center of thickness of the upstanding page stack A clamped by main clamper 50 in the page receiving position is somewhat offset to right, in FIG. 2, with respect to a center of a heater roll 64 to be described hereinlater. Though its glueing position is not shown in FIG. 2, it is to be understood that this position is in close vicinity to the page receiving position and, more specifically, may be obtained by slight parallel translation to left, in FIG. 2, from the page receiving position until the center of thickness of the upstanding page stack A clamped by main clamper 50 is just aligned with the center of heater roll 64.

Similar to the end portions of table 24 and clamping plate 25 of sub-clamper 20, a pair of clamping plates 51, 52 respectively have teethed end portions comprising spaced projections 51*a*, 52*a* and recesses 51*b*, 52*b* defined between adjacent projections. However, such end portion arrangement of main clamper 50 is complementary with respect to the end portion arrangement of sub-clamper 20, so that the teethed end portions of sub-clamper 20 and main clamper 50 engage with each other. More specifically, as best seen in FIG. 4, when sub-clamper 20 has reached the delivery position, projections 24*a*, 25*a* of table 24 and clamping plate 25 which cooperate with each other to clamp the page stack A therebetween enter recesses 51*b*, 52*b* of clamping plates 51, 52 of main camper 50 which has been waiting at the page receiving position, whereas projections 51*a*, 52*a* of main clamper 50 go into recesses 24*b*, 25*b* of sub-clamper 20.

Figure 7:
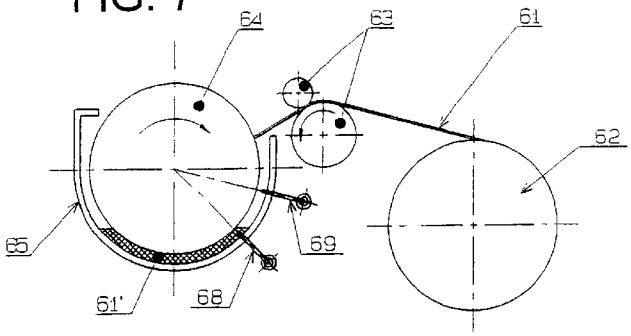
FIG. 7 is an explanatory view showing a heater unit of this bookbinding device.

Adhesive applicator 3 (FIG. 1) is shown in the embodiment of FIG. 2 as a heater unit 60 which comprises a roller 62 from which a continuous sheet 61 of hot melt adhesive material is unreeled, a pair of feed rollers 63 for feeding hot melt adhesive sheet 61 along a predetermined travel path, a rotating heater roll 64 heated to above a melting point of hot melt adhesive material of sheet 61 and adapted to be in contact with a leading end of sheet 61 fed by feed rollers 63 for melting sheet 61, a housing 65 for receiving the molten adhesive, a drive mechanism for rotating heater roll 64 in a predetermined direction, that is in a clockwise direction in FIGS. 2 and 7, and another drive mechanism for elevation of heater roll 64. Housing 65 is provided with temperature sensors 68, 69 at different levels to confirm that a predetermined quantity range of the molten adhesive is contained in housing 65 from a difference of temperature detected by these sensors.

Cover supply unit 5 (FIG. 1) is shown by a reference numeral 70 in the embodiment of FIG. 2, which comprises a cassette 71 that receives a stack of cover sheets B, a first feed roller 72 for feeding a cover sheet B, one by one, from cassette 71 at controlled time intervals, and a series of subsequent feed rollers 73 for feeding cover sheet B along a travel path toward trimmer 6, and further to the bookbinding station where the back surface of page stack A is bonded to the center portion of cover sheet B. The last feed roller is a positioning roller 81 to be described hereinlater, which constitutes positioning unit 7 (FIG. 1). Cover sheets B in cassette 71 have a predetermined size which depends upon the size (A4, B5, . . . ) of pages A on table 24 to be bound. Cassette 71 may be adapted to receive some kinds of cover sheets B of different sizes, in which case there is preferably provided a size sensor for detecting the size of cover sheets B now received in cassette 71. Cover supply unit 5 also has a series of sensors for detecting that cover sheet B is actually fed along the predetermined travel path, including a cutter position sensor 74 to be described hereinlater and sensors 82–84.

Figure 9:
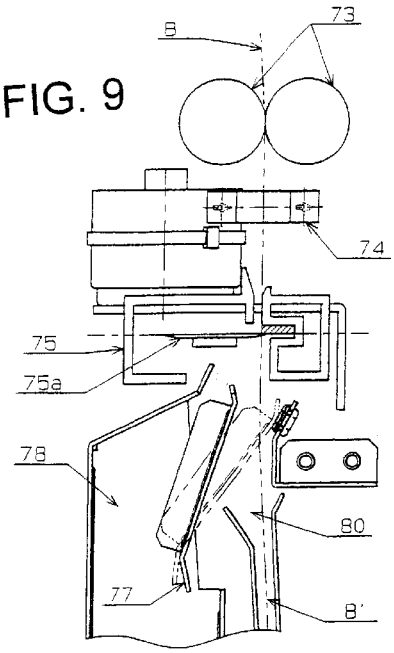
FIG. 9 is a front view showing a scrap discharging unit of this bookbinding device.
Figure 8:
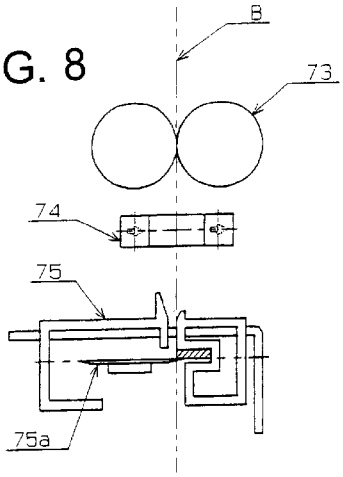
FIG. 8 is a front view showing a cutter unit and elements associated thereto of this bookbinding device.
Figure 10:
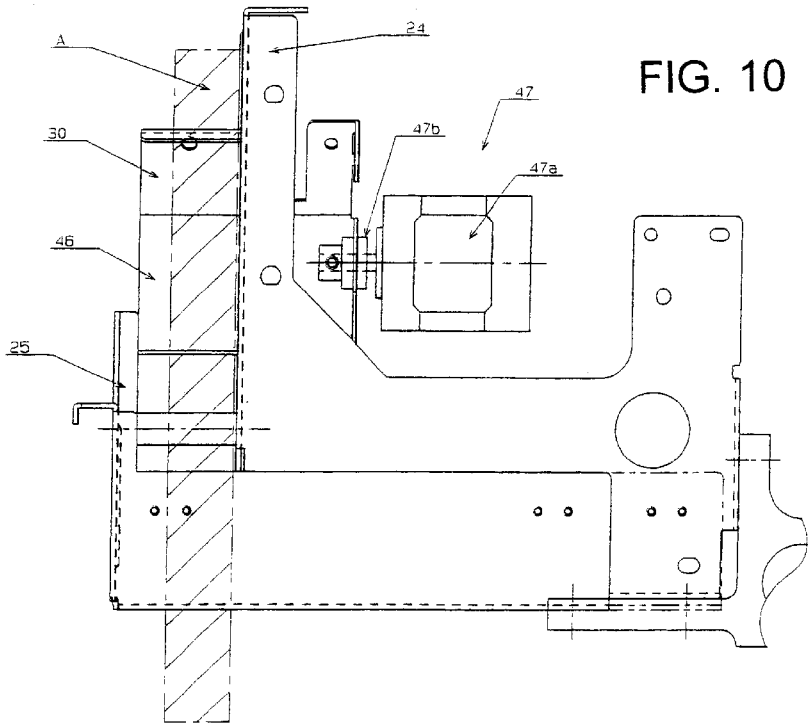
FIG. 10 is a side view of the jog unit.

Trimmer 6 (FIG. 1) is arranged along the travel path of cover sheet B defined by feed rollers 73, which comprises in the embodiment of FIG. 2 the above-described cutter position sensor 74 and a cutter 75 with a blade 75*a*, as shown in FIGS. 8 and 9. Cutter blade 75*a* is driven by a motor, not shown.

After being trimmed by cutter 75 to a predetermined size in reference to the thickness of page stack A to be bound, cover sheet B is then fed by a cover chute 80 and rollers 73 to a definite position which is determined by positioning unit 7. In the meantime, scraps produced by cutting cover sheet B by cutter 75 is discharged by scrap discharging unit 11 (FIG. 1) along a predetermined discharge path which is separate from the post-cutter travel path of cover sheet B. Scrap discharging unit 11 comprises in the embodiment of FIG. 2 a changeover switch or rotatable flap 77 controlled in synchronism with operation of cutter 75, and a scrap chute 78 arranged in vicinity to cover chute 80 for discharging therethrough the scraps. At the time when cutter 75 operates to trim one side edge portion of cover sheet B, flap 77 is positioned as shown by dotted lines in FIGS. 2 and 9 to provide a greater opening at a top of scrap chute 78, just beneath cutter 75, for receiving the scraps falling down from cutter 75 and guiding them into scrap chute 78. Immediately after that, flap 77 is returned to a position shown by solid lines in FIGS. 2 and 9 to allow the trimmed cover sheet B' to go into cover chute 80.

Figure 16:
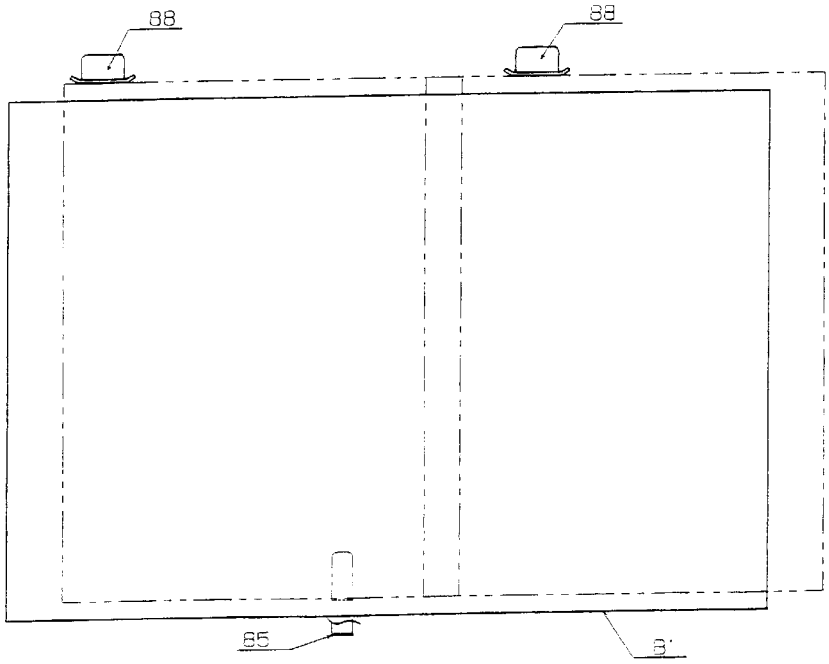
FIG. 16 is an explanatory view showing positioning of the cover sheet in its width directions.

The cover travel path is bent beneath the exit of cover chute 80 and guide rollers 83, 84 to provide a substantially horizontal travel plane leading to the bookbinding position (FIG. 1). Within this horizontal travel plane of the trimmed cover sheet B', there are located positioning rollers 81 and positioning pin 85, as specifically shown in FIG. 12. Positioning roller 81 is usually kept in press contact with a lower opposite roller 86 but is separable therefrom by an elevating mechanism 87. More particularly, positioning roller 81 is elevated to separate from roller 86 just before the trimmer cover B' reaches a predetermined position where the back surface of page stack A is adhesively bonded to the center portion of the trimmed cover B' and the latter is folded along the opposite side edges of page stack A. Positioning pin 85 is elevatable between the operative position shown in FIG. 12 and a lower stand-by position, as well as movable horizontally, that is, in parallel with the cover travel path near the bookbinding position. Positioning pin 84 is elevated from the stand-by position to the operative position and moved forward in the cover feeding direction, while positioning roller 81 is kept standstill apart from the lower roller 86, so that it cooperate with a stationary guide to be described hereinlater in reference to FIG. 16 for exact adjustment of position of the trimmed cover sheet B' which has been fed nearly to the bookbinding position. Then, positioning roller 81 is lowered and driven to the trimmed cover sheet B' to the bookbinding position.

In the embodiment of FIG. 2, functions of press unit 8 and folding unit 9, both in FIG. 1, are achieved by a single unit, bookbinding unit 90, which comprises a pair of forming plates 91, 91, a drive mechanism 92 for opening and closure of forming plates 91, 91, a movable plate 93 just beneath forming plates 91, 91, a shift mechanism 94 for moving plate 93 on a horizontal plane, an elevating mechanism 95 for elevation of entirety of bookbinding unit 90 between a stand-by position by solid lines and an operative position shown by dotted lines. Forming plates 91, 91 are arranged in a symmetric design with respect to the center of thickness of page stack A which is clamped upstanding by main clamper 50, whenever they are opened or closed.

Movable plate 93 has a slit, now shown, which is broad enough to pass therethrough maximum thickness (20 mm, for example) of a booklet which can be produced by the bookbinder of this embodiment. When movable plate 93 is located at a position shown in solid and dotted lines in FIG. 2, the slit position is not aligned with an opening between forming plates 91, 91, which becomes vertically aligned with the opening when bookbinding unit 90 is slightly moved from that position to right, in FIG. 2 by shift mechanism 94. The former position is defined as a shut-off position and the latter as a straightway position.

Beneath bookbinding unit 90 is arranged booklet conveyor unit 10 (FIG. 1) which, in the embodiment of FIG. 2, comprises the slit of movable plate 93 when it is aligned with the opening between forming plates 91, 91, and a guide wall 96 for guiding booklet C falling down through the slit toward a belt conveyor 97 by which booklet C is conveyed to a predetermined safekeeping station.

Operation of the respective elements of the above-described bookbinding device is controlled by a controller, not shown, which will be described in detail in reference to flowcharts of FIGS. 13–15.

Figure 13:
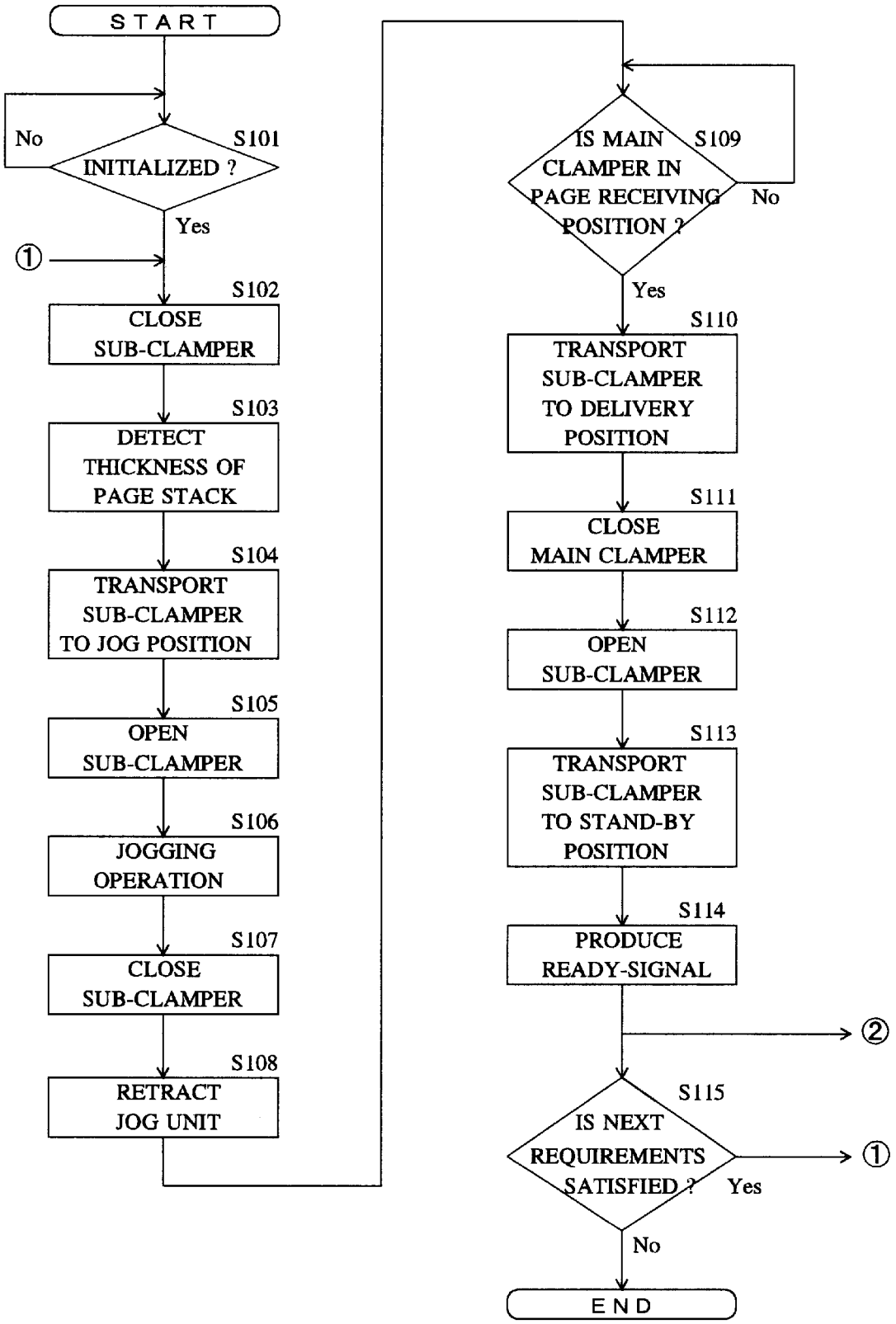
FIG. 13 is a flowchart showing page supply operation of this bookbinding device, the operation including supply of the page stack by the sub-clamper, jogging thereof by the jog unit and delivery thereof from the sub-clamper to the main clamper.

Referring specifically to the flowchart of FIG. 13 illustrating page supply operation of this bookbinding device including supply of page stack A by sub-clamper 20, jogging thereof by jog unit 40 and delivery thereof from sub-clamper 20 to main clamper 50, it is first confirmed at S101 if all the initial requirements are satisfied. The initial requirements may include, for example, that sub-clamper 20 is in the delivery position, that jog unit 40 is in the stand-by position, that some page stack A is set on table 24 of sub-clamper 20, that some cover page B of a size corresponding to the size of page stack A on table 24 is contained in cassette 71 of cover supply unit 70 (which is confirmed by the page size sensor and the cover size sensor), that a necessary amount of molten adhesive 61' is contained in housing 65 of heater unit 60, a starter switch (not shown) of the bookbinding device is already ON, etc.

After confirming that all the initial requirements are satisfied at S101, clamping plate 25 of sub-clamper 20 is moved down toward table 24 to clamp page stack A therebetween (at S102), followed by detection of thickness of the clamped page stack A by sensor 21 (at S103). The bookbinding device according to the embodiment of FIG. 2 is capable of binding page stack A of thickness ranging from 1.5 mm to 20 mm. When the result of detection by sensor 21 is smaller or larger than that range, sub-clamper 20 is opened to unclamp page stack A and an error message appears on a display, not shown, of the device.

Then, at S104, sub-clamper 20 is moved to the jog position and stopper 28 is rotated to the retracted position shown by dotted lines in FIG. 2 to disengage the front end of the clamped page stack A. At S105, jog unit 40 is moved by drive mechanism 41 from the stand-by position to the operative position shown by solid lines in FIG. 2, and clamping plate 25 is slightly opened to unclamp page stack A, followed by jogging operation for a predetermined period of time (at S106). The jogging operation carried out by jog unit 40 has been described in detail in reference to FIGS. 5, 6, 10 and 11. During the jogging operation, main clamper 50 which has carried out the bookbinding operation at the bookbinding position is moved to the page receiving position, and another cover page B is supplied from cassette 71 of cover supply unit 70.

After the jogging operation is over, clamping plate 25 is again moved toward table 24 to clamp page stack A therebetween (at S107), and jog unit 40 is moved to the retracted position shown by double-dotted lines in FIG. 2 (at S108).

Then, after confirming at S109 that main clamper 50 has already been returned to the page receiving position, sub-clamper 20 which clamps the jogged page stack A is moved to the delivery position by drive mechanism 22 (at S110). Main clamper 50 is opened as shown in FIG. 4(*a*) at this time. Then, main clamper 50 is closed at S111 and sub-clamper 20 is opened at S112. As described before, projections 24*a*, 25*a* formed at the front end of sub-clamper 20 enter recesses 51*b*, 52*b* of clamping plates 51, 52 of main clamper 50 whereas projections 51*a*, 52*a* of main clamper 50 go into recesses 24*b*, 25*b* of sub-clamper 20, as shown in FIG. 4(*b*), so that page stack A may be surely delivered from sub-clamper 20 to main clamper 50 while keeping the jogged condition, as shown in FIG. 4(*c*).

Sub-clamper 20 that is opened at S112 is returned to the stand-by position for waiting supply of another page stack A onto table 24 (at S113). A signal indicating that main clamper 50 clamping the jogged page stack A becomes ready to move from the page receiving position to the glueing position (at S114). Then, after confirming at S115 that all the requirements for subsequent bookbinding operation are fulfilled, the procedure is returned to S102. The requirements for subsequent bookbinding operation may include, for example, that a page stack A is set on table 24 of sub-clamper 20, the start switch is ON, etc. If any one of such requirements is not satisfied within a predetermined time limit, it is discriminated that the bookbinding operation has been finished, and the device is made inoperative.

Figure 14:
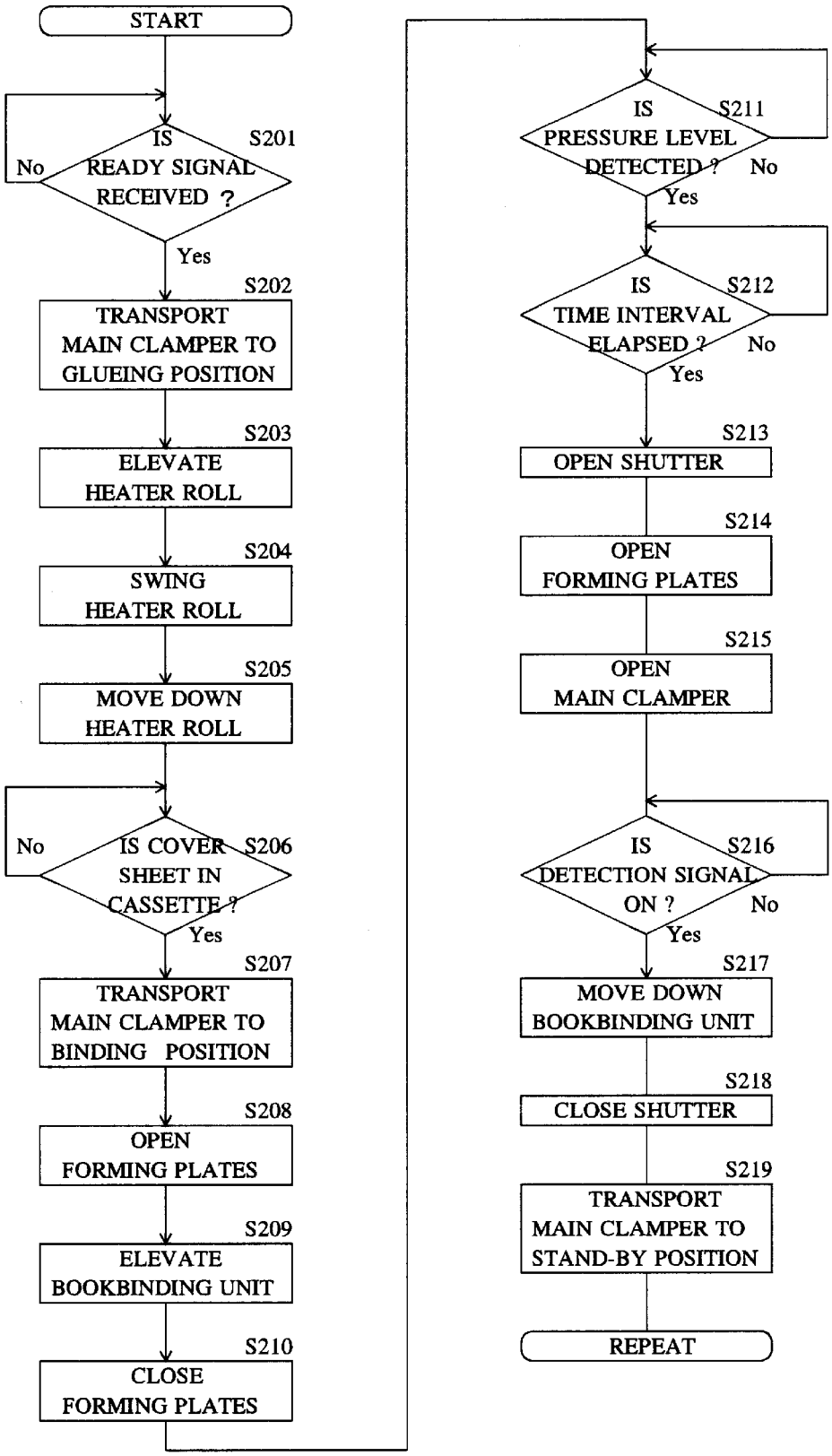
FIG. 14 is a flowchart showing successive operation of this bookbinding device, the operation including glueing to a back surface of the page stack, adhesive bonding of the page stack to a cover sheet and folding of the cover sheet.

Referring now to the flowchart of FIG. 14 which illustrates successive operation of this bookbinding device including glueing to a back surface of page stack A, adhesive bonding of page stack A to the trimmed cover sheet B' and folding of the latter, the procedure start with a step S201 for confirming that the ready signal has been output at S114, followed by a step S202 for moving main clamper 50 from the page receiving position to glueing position. It is to be reminded that the page receiving position of main clamper 50 is somewhat offset to right, in FIG. 2, with respect to the center axis of heater roll 64. Main clamper 50 is moved from this position to the glueing position where the center of thickness of the upstanding page stack A clamped by main clamper 50 is just aligned with the center axis of heater roll 64, in reference to thickness of the page stack A clamped by sub-clamper 20, which has been detected by sensor 21 at S103 of the flowchart of FIG. 13.

Next, at S203, heater roll 64 is elevated by elevating mechanism 67. Heater roll 64 is usually caused to rotate in a predetermined direction (in a clockwise direction in FIG. 7) by rotary drive mechanism 66 so that the periphery at the top will carry a predetermined amount of molten adhesive 61'. Before it begins to ascend, heater roll 64 stops rotating. At the elevated position, heater roll 64 comes into contact under pressure with the back surface of page stack A clamped upstanding by main clamper 50 at the glueing position, and then is subjected to rotation for a predetermined period of time in opposite directions within a predetermined small angle (±5 degrees, for example), at S204, so that molten adhesive 61' may not only be applied to the back surface of the clamped page stack A but also go into gaps between adjacent pages of stack A, followed by moving down to the stand-by position (at S205). Now, the glueing operation by heater unit 60 is finished.

Then, it is confirmed at S206 if the trimmed cover sheet B' has been supplied to a predetermined position on forming plates 91, 91 of bookbinding unit 90, and main camper 50 is further moved to left, in FIG. 2, to the bookbinding position (at S207). At the bookbinding position of main clamper 50, the center of thickness of the glued back surface of page stack A clamped thereby is just aligned with the center of forming plates 91, 91. The center of the trimmed cover sheet B' supplied into position is also aligned with the center of forming plates 91, 91. The positioning of cover sheet B' will be described hereinlater in reference to the flowchart of FIG. 15.

Referring again to the flowchart of FIG. 14, forming plates 91, 91 are opened by drive mechanism 92 (at S208), and bookbinding unit 90 is elevated by elevation mechanism 95 from the stand-by position shown by solid lines in FIG. 2 to the operative position shown by dotted lines in FIG. 2 (at S209). During elevation of bookbinding unit 90, the glued back surface of page stack A clamped upstanding by main clamper 50 at the bookbinding position enters a gap between the opened plates 91, 91 and contacts under pressure with plate 93 with cover sheet B' being interposed therebetween, so that the back surface of page stack A is bonded to the center position of cover sheet B' by hot melt adhesive 61' on the back surface of page stack A. Position of movable plate 93, when elevated, is shown by double-dotted lines in FIG. 12, but it is to be noted that forming plates 91, 91 are shown as in the closed position, which is achieved at S210.

Yes, the step to be done subsequent to S209 is to close forming plates 91, 91 while bookbinding unit 90 is kept standstill at the elevated position, whereby cover sheet B' is folded inwardly along opposite side edges of the back surface of page stack A. A pressure level to be applied by closure of forming plates 91, 91 is detected by a pressure sensor, not shown, at S211. The bookbinding operation at S209 begins when the forming pressure reaches a predetermined level and ends when a predetermined period of time (2 seconds, for example) passes, which is detected at S212.

After the bookbinding operation is finished (at S213), plate 93 is moved by drive mechanism 92 from the shut-off position to the straightway position where the slit or booklet passage thereof is aligned below with the center of forming plates 91, 91, which are then opened (at S214), and main clamper 50 is then opened to unclamp page stack A which is now bonded to cover sheet B' into a unitary assembled booklet C (at S215). Thus, booklet C passes through the gap between the opened forming plates 91, 91 and the slit of movable plate 93, due to its own weight, and is guided along guide wall 96 onto running belt conveyor 97. Belt conveyor 97 is provided with a sensor, not shown, at any position downstream of the lower end of guide wall 96, which sends a detection signal each time when booklet C has passed the sensor position. When outputting the detection signal (Yes at S216), bookbinding unit 90 is moved from the upper, operative position to the lower, stand-by position (at S217), and plate 93 is returned to the shut-off position (at S218). Finally, main clamp 50 is returned to the stand-by position shown by solid lines in FIG. 2 (at S219).

A series of the above-described steps from S201 to S219 is executed each time in response to the signal output at S114 of the flowchart of FIG. 13 for automated continuous bookbinding operation.

Figure 15:
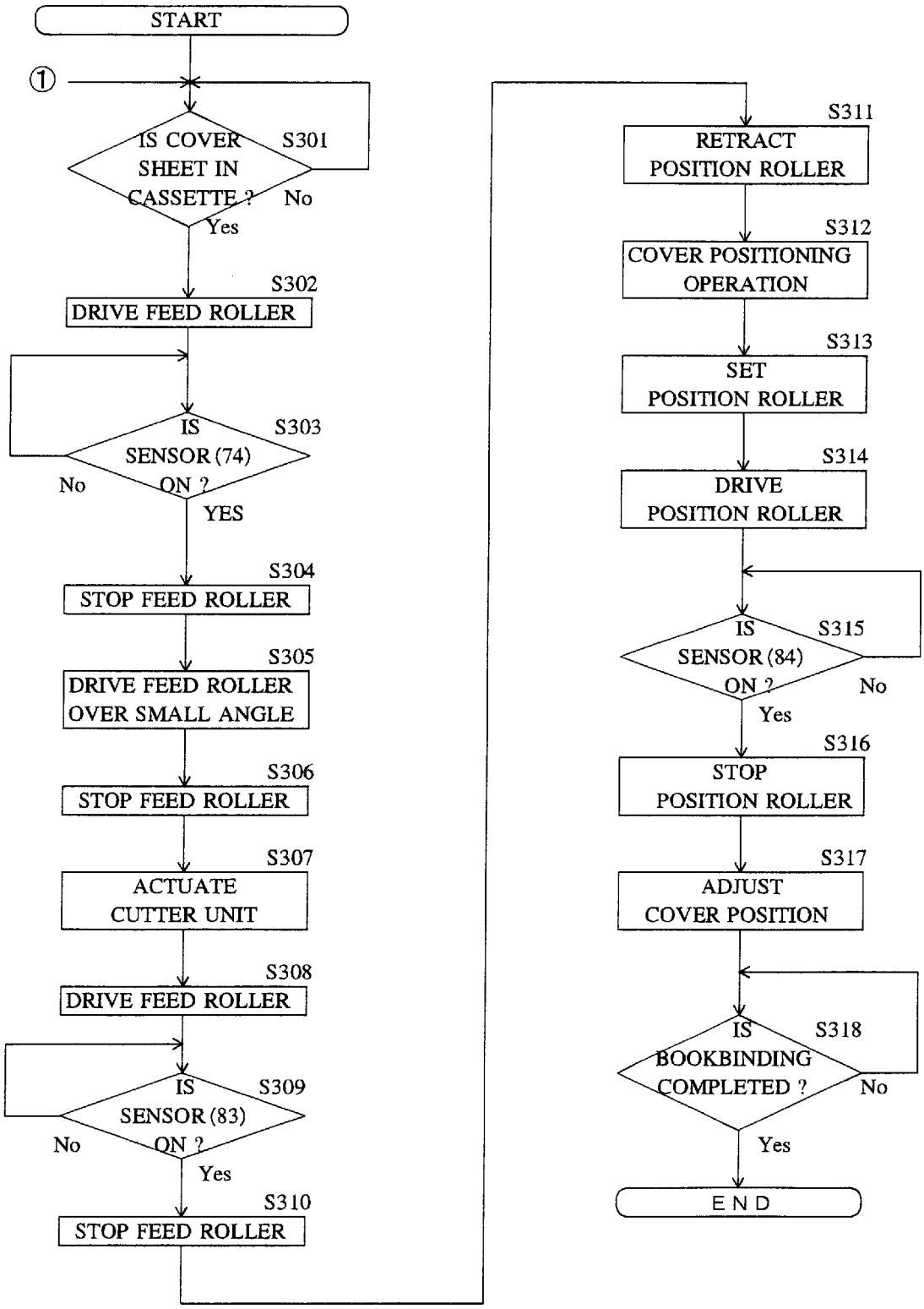
FIG. 15 is a flowchart showing cover supply operation of this bookbinding device, the operation including trimming of the cover sheet, discharge of scraps and positioning of the trimmed cover sheet.

Reference should now be made to the flowchart of FIG. 15 which illustrates cover supply operation of this bookbinding device including trimming of cover sheet B, discharge of scraps and positioning of the trimmed cover sheet B'.

Figure 12:
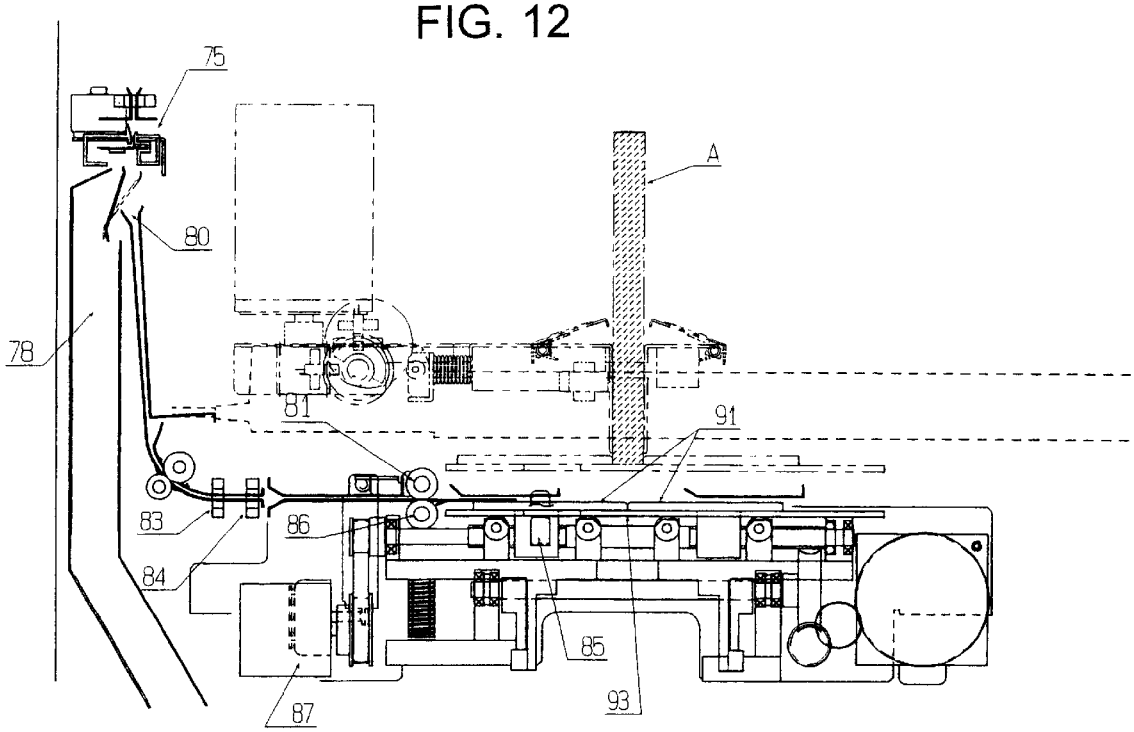
FIG. 12 is a front view showing a cover positioning unit of this bookbinding device.

After confirming at S115 of the flowchart of FIG. 12 that all the requirements for subsequent bookbinding operation are fulfilled, it is confirmed if at least one cover sheet B is received in cassette 71, at S301. When this is confirmed (Yes at S301), first feed roller 72 is driven to feed one cover sheet B among those received in cassette 71 along the cover travel path defined by feed rollers 73, at S302. Cutter position sensor 74 located upstream in vicinity to cutter 75 is turned on when it detects passing therethrough of the forward end of cover sheet B, which is confirmed at S303 to stop feed roller 72 at S304. Then, feed roller 72 is again driven to rotate over a small angle to feed cover sheet B by a predetermined distance (L1) at S305, followed by again stopping feed roller 72 at S306. Consequently, the forward end portion of cover sheet B extending downward beyond the position of cutter blade 75*a* has a length (L1−L2), where (L2) designates a distance of the cover travel path extending between the sensor position to the cutter blade position. Then, cutter blade 75*a* is moved perpendicular to the cover travel path so as to cut or trim the extending forward end portion of cover sheet B, at S307.

Cover sheet B received in cassette 71 has a predetermined size which depends on a size of page stack A to be bound. More particularly, a length (WB) of cover sheet B in its travelling direction is determined by the following equation (1), where (WA) represents a width of page stack A, (V) a cutting margin corresponding to a thickness of cutter blade 75*a*, (α) a margin left for applying hot melt adhesive by heater unit 60 and folding cover sheet B' by bookbinding unit 90, and (Tmax) the maximum thickness of a booklet which may be produced by using this bookbinding device:

$$WB=(WA+\alpha)\times 2+T\max+V \quad (1)$$

Supposing (TA) represents the thickness of page stack A detected by sensor 21, the length (L1−L2) of the forward end portion of cover sheet B to be trimmed by cutter 75 should be a difference between the maximum bookbindable thickness and the actual thickness, that is (Tmax−TA). Accordingly, the feed amount (L1) at S305 should be determined by the following equation (2):

$$L1=T\max-TA+L2 \quad (2)$$

The length (WB') of cover sheet B' after being trimmed is expressed by the following equation (3):

$$WB'=(WA+\alpha)\times 2+TA \quad (3)$$

Feed roller 72 is again driven to resume feeing the trimmed cover sheet B' (at S308) until sensor 83 is turned on by detecting passing of the rear end of the trimmed cover sheet B' (at S309). When sensor 83 is turned on (Yes at S309), feed roller 72 is brought to a stop (at S310) and positioning roller 81 is elevated to separate from the opposing roller 86 (at S311), followed by definite positioning of cover sheet B' by controlled movement of positioning pin 85 (at S312).

Positioning pin 35 is arranged to be engageable with one side edge of cover sheet B' when cover sheet B' is fed to the bookbinding station, which cooperates with opposing stationary guide pins 88, 88 (FIG. 16) to slightly move cover sheet B' toward a definite position where the glued back surface of page stack A is adhesively bound to the center of cover sheet B'. Positioning pin 35 stands by at a lower position below the cover travel path but is elevated at S 312 to come into engagement with the one side edge of cover sheet B', and is further elevated to lift the said one side edge of cover sheet B', which is slightly moved forward at a low speed so that the opposite side edge of cover sheet B' engages with stationary guide pins 88, 88 which defines the side edge position or alignment of cover sheet B' with respect to position of page stack A carried by main clamper 50 at the bookbinding position. In summary, the operation at S312 is to amend positioning of cover sheet B' at the bookbinding station, especially in a direction perpendicular to the cover travel path.

After completing the cover positioning operation at S312, positioning pin 35 descends toward the stand-by position, positioning roller 81 is moved downward for press-contact with opposing roller 86 (at S313) and driven to resume feeding cover sheet B' (at S314). When sensor 84 is turned on by detecting passage of the rear end of cover sheet B' (Yes at S315), positioning roller 81 comes to a stop (at S316) so that cover sheet B' is fed to a reference position on forming plates 91, 91 but still does not reach a position suitable to bookbinding which should vary depending upon the thickness (TA) of page cover A. The reference position of cover sheet B' at S316 may be determined as a position where its center of width is aligned with the center of thickness of page stack A clamped by main clamper 50 which has been moved to the bookbinding position (at S207 of the flowchart of FIG. 14), when (TA) is equal to (Tmin), (Tmin) representing the minimum thickness of a booklet which may be produced by this bookbinding device, that is 1.5 mm in this embodiment. The reference position determined as described above is offset from the center of thickness of page stack A at the bookbinding position by half a difference between the actual thickness and the minimum thickness of the booklet, that is (TA−Tmin)/2.

Thus, the cover positioning operation ends at S317 where positioning roller 81 is driven to feed cover sheet B' by an offset amount calculated by the above equation, for awaiting completion of the bookbinding operation at S318. When the bookbinding operation is finished (Yes at S318), a series of the above-described steps from S301 to S318 of the flowchart of FIG. 15 is over.

As apparent from the foregoing description, because a bookbinding device according to the present invention involves a step of trimming a side edge portion of a cover sheet in dependence upon thickness of a page stack, a post-trimming step may be omitted and it becomes possible to produce booklet C having a cover of a size exactly corresponding to a size of page stack A. The concept underlying the present invention allows printing to be applied to the cover page during the bookbinding operation, because the exact center position of the cover page, after being trimmed, may be determined, which means that the present invention is useful in full-page printing.

Although the present invention has been described in conjunction with specific embodiments thereof, it is to be understood that the present invention is not limited to these embodiments and many modifications and variations may be made without departing from the scope and spirit of the present invention as specifically defined in the appended claims.

What is claimed is:

1. A bookbinding device comprising:

a page supply unit for supplying a stack of pages to be bound to a predetermined first station, said page stack being kept in a clamped condition from opposite sides thereof;

a thickness sensor for detecting thickness of the clamped page stack during supply thereof by said page supply unit;

an adhesive applicator for applying molten adhesive to a back surface of said page stack at said first station;

a page conveyor unit for conveying said page stack with said glued back surface from said first station to a second station remote from said first station;

a cover supply unit for supplying a cover sheet to beneath said glued back surface of said page stack at said second station;

a press unit for contacting under pressure said glued back surface of said page stack with a center portion of said cover sheet for adhesive binding therebetween; and a cover folding unit for folding said cover sheet substantially along opposite side edges of said page stack to form a unitary assembled booklet;

said cover supply unit including:

a trimmer for trimming a side edge portion of said cover sheet depending upon thickness of said page stack detected by said thickness sensor, and a positioning unit for positioning said cover sheet such that a center line of said cover sheet which has been trimmed by said trimmer is aligned with a center of thickness of said page stack at said second position.

2. The bookbinding device according to claim 1 which further comprises a scrap discharging unit for discharging scraps produced after said trimmer trims said side edge portion of said cover sheet, through a scrap chute that is independent from a cover sheet travel path defined by said cover supply unit.

3. The bookbinding device according to claim 2 which further comprises a changeover switch arranged just beneath said trimmer, said changeover switch being regulated in synchronism with operation of said trimmer so as to guide said scrap into said scrap chute and guide said trimmed cover sheet to feed along the cover sheet travel path.

4. The bookbinding device according to claim 1 which further comprises a printer unit arranged along the cover sheet travel path between said trimmer and said second station for printing any desired image on said trimmed cover sheet.

5. The bookbinding device according to claim 1 wherein said page supply unit comprises:

a clamper for clamping said page stack from opposite sides thereof;

a release mechanism for unclamping said page stack at a jogging station where said page stack is kept substantially upstanding or slanting;

a holder unit with a bottom support for supporting a bottom edge of said page stack when said page stack is unclamped by said release mechanism;

a first vibration generator for vibrating said holder unit in up-and-down directions to jog said bottom edge of said page stack;

a second vibration generator for vibrating said page stack in its width directions to jog opposite side edges of said page stack; and a spring-biased press member for press- and resilient-contact with a top edge of said page stack while being vibrated in up-and-down directions by said first vibration generator.

6. The bookbinding device according to claim 5 wherein said holder unit comprises a base to which said bottom support is fixed, and a second bottom support slidably connected to said base, said bottom support providing a supporting surface positioned between an uppermost position and a lowermost position of said elevatable second bottom support, said second bottom support being vibrated by said first vibration generator.

7. The bookbinding device according to claim 5 wherein said holder unit further comprises a stationary guide member for definitely positioning a first side edge of said page stack and a movable guide member adapted to provide resilient contact with a second side edge, opposite to said first side edge, of said page stack.

8. The bookbinding device according to claim 5 wherein said second vibration generator comprises a swingable arm with a contact surface opposing to said second side edge of said page stack, and an actuator for swinging said arm so that said contact surface intermittently collides against said second side edge of said page stack.

9. A bookbinding device comprising:

a clamper for clamping a stack of pages from opposite sides thereof;

a release mechanism for unclamping said page stack at a jogging station where said page stack is kept substantially upstanding or slanting;

a holder unit with a bottom support for supporting a bottom edge of said page stack when said page stack is unclamped by said release mechanism;

a first vibration generator for vibrating said holder unit in up-and-down directions to jog said bottom edge of said page stack;

a second vibration generator for vibrating said page stack in its width directions to jog opposite side edges of said page stack; and a spring-biased press member for press-contact with a top edge of said page stack while being vibrated in up-and-down directions by said first vibration generator.

10. The bookbinding device according to claim 9 wherein said holder unit comprises a base to which said bottom support is fixed, and a second bottom support slidably connected to said base, said bottom support providing a supporting surface positioned between an uppermost position and a lowermost position of said elevatable second bottom support, said second bottom support being vibrated by said first vibration generator.

11. The bookbinding device according to claim 9 wherein said holder unit further comprises a stationary guide member for definitely positioning a first side edge of said page stack and a movable guide member adapted to provide resilient contact with a second side edge, opposite to said first side edge, of said page stack.

12. The bookbinding device according to claim 9 wherein said second vibration generator comprises a swingable arm with a contact surface opposing to said second side edge of said page stack, and an actuator for swinging said arm so that said contact surface intermittently collides against said second side edge of said page stack.

13. A bookbinding method comprising the steps of:

supplying a stack of pages to be bound to a first station, said page stack being kept in a clamped condition from opposite sides thereof;

detecting thickness of the clamped page stack during supply thereof;

applying molten adhesive to a back surface of said page stack at said first station;

conveying said page stack with the glued back surface from said first station to a second station remote from said first station;

trimming a side edge portion of a cover sheet depending upon thickness of said page stack;

supplying said cover sheet with the trimmed side edge portion to beneath the glued back surface of said page stack such that a center line of said cover sheet is aligned with a center of thickness of said page stack at said second position;

contacting under pressure the glued back surface of said page stack with said cover sheet for adhesive binding therebetween; and folding said cover sheet substantially along opposite side edges of said page stack to form a unitary assembled booklet.

* * * * *